US005165143A

United States Patent [19]

Detchon

[11] Patent Number: 5,165,143

[45] Date of Patent: Nov. 24, 1992

[54] BROOM OR TOOL HANDLE STOP DEVICE

[76] Inventor: Susan Detchon, Motherload Prod Dev. Corp., P.O. Box 7664, Greenwich, Conn. 06836

[21] Appl. No.: 740,101

[22] Filed: Aug. 5, 1991

[51] Int. Cl.[5] ..... B25G 1/00
[52] U.S. Cl. ..... 16/111 R; 16/DIG. 12
[58] Field of Search ..... 16/111 R, DIG. 12

[56] References Cited

U.S. PATENT DOCUMENTS 184,918 11/1876 Siddall ..... 16/DIG. 12
1,980,655 11/1934 Balistreri ..... 16/DIG. 12

FOREIGN PATENT DOCUMENTS 2185209 7/1987 United Kingdom ..... 16/111 R

*Primary Examiner*—John Sipos
*Assistant Examiner*—Carmine Cuda
*Attorney, Agent, or Firm*—Alfred E. Miller

[57] ABSTRACT

A stop device for placement over the extreme end of an elongated handle of the type used for a broom, mop, rake, or the like, which has a frictional outer surface so that when the handle is placed in an upright position against a vertical wall it is prevented from sliding off the wall to the floor or ground. The device is in the form of a sleeve having a circumferential score line medially thereon so that the sleeve can be severed along the score line to provide two separate stop members, either of which can be used with an elongated handle.

8 Claims, 2 Drawing Sheets

BROOM OR TOOL HANDLE STOP DEVICE

The present invention relates to an attachment for an elongated handle for a broom, mop, rake or the like. Its function is to prevent the handle and/or tool from sliding off a wall or counter surface and onto the floor. Thus, the attachment prevents slippage of the tool or broom handle when it is placed against a vertical surface either on the interior or exterior walls of a structure.

BACKGROUND OF THE INVENTION

It is known that elongated handles for brooms or tools are often placed against a vertical wall, either inside or outside of a dwelling, when they are not in use. Consequently, the walls may have a relatively smooth surface and the broom handle is also smooth so that it is difficult to retain the broom or other tool handle in an upright position on the wall surface. If the handle slides off the wall, or other upright surface, one must bend down to pick up the broom, or worst still, a situation could arise whereby the broom handle falls down and strikes either a small child, baby, or a pet animal.

Many arrangements and devices have been made in order to overcome this problem. For example, U.S. Pat. No. 2,422,891 to Dickson shows a broom handle in which a handle is held in a bracket screwed to the wall. U.S. Pat. No. 2,441,051 to Wilhelm shows another type of hanger in which a bracket holds the broom in an inverted position with the bristles in an upright position.

U.S. Pat. No. 2,506,3333 to Bedynek shows a holder device attached at the extreme end of the broom handle and which is held by a hook mounted on the wall. Furthermore, in order to suspend the extreme end of a elongated handle U.S. Pat. No. 4,519,566 to Manzi shows a wire bail which can be placed over a hook mounted on a vertical wall. U.S. Pat. No. 3,132,834 to Adams shows a two section handle for a mop in which the sections are pivotally connected, and which is provided with a T-shaped foot having a rubber covering to prevent slippage on the floor. None of the above prior art elongated handle holders show a device which can be placed over an extreme end of an elongated handle so that the handle can be leaned against a vertical wall or counter and retained in position. In contradistinction, the present device successfully maintains the handle in an upright vertical position against the wall anywhere around the circumference of the free end of the handle.

SUMMARY OF THE INVENTION

It is an object of the present invention to provide a stop device with a frictional outer surface for insertion over the extreme end of an elongated handle for brooms, rakes, tools, or the like.

It is a further feature of the present invention to provide a rubber band like element that is rolled down over a shaft to deter movement of the shaft when the shaft or handle is placed against any stationary object, such as a wall or a counter.

An object of the present invention is to provide a rubber band either having a closed or open top and provided with a plurality of raised nubs or frictional surface circumferentially about the band in order to provide a frictional gripping surface for the wall or counter, when the end of the elongated handle is placed thereagainst.

It is a further feature of the present invention to provide a rubber-like closed end band for use on the extreme end of a elongated handle of a broom or a tool, and which can be separated circumferentially to provide both a band having one closed end and a second band having both open ends. Consequently, depending upon the intended use, either of these bands may be selected.

It is another object of the present invention to provide a frictional stop device which can be inserted over the free end of a elongated handle of a broom, rake, or other tool, and which can remain on the handle at all times, even when the broom or other devices are in use. Furthermore, the device is not bulky and it is so designed that its frictional outer surface can engage the wall and any position of the broom handle.

A further feature of the present invention is to provide a flexible stop member which can be inserted over the free end of a broom handle, and if desired, the same can be easily removed.

Another feature of the present invention is to provide a rubber-like sleeve that can be inserted over the free end of a broom handle and which is provided with a plurality of holes for releasing the vacuum within the sleeve when the sleeve is inserted over the broom handle.

The above features and objects of my invention will be more fully understood by the following description of the construction and operation in the specification and by reference to the accompanying drawings forming a part thereof and in which:

DESCRIPTION OF THE PREFERRED EMBODIMENTS

Figure 1:
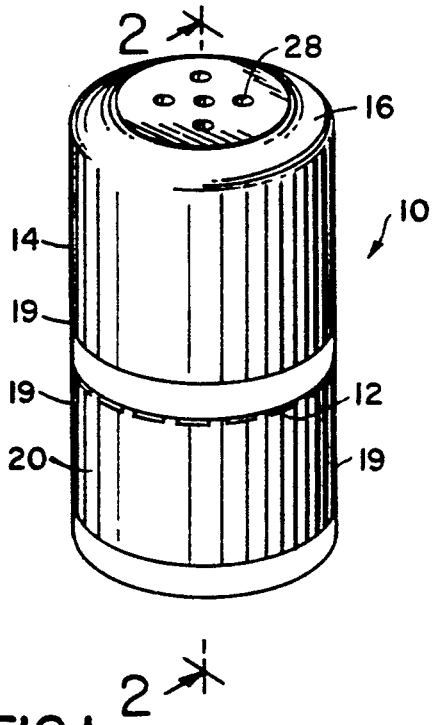
FIG. 1 is a perspective view of the broom or tool stop constructed in accordance with the teachings of my invention.
Figure 2:
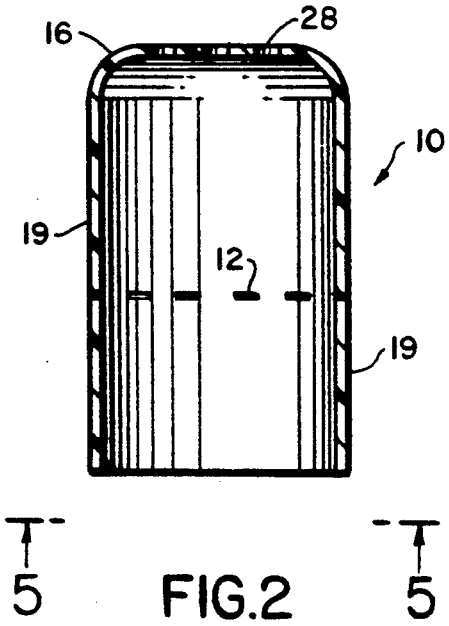
FIG. 2 is a sectional view of my invention taken along the lines of 2—2 of FIG. 1.

The stop device for a long handled implement such as a broom, rake, mop or any other manual work device employing an elongated handle H is referred to generally by the reference numeral 10 is a flexible sleeve like element fabricated of a rubber or thermoplastic resin. The device as shown in FIG. 1 is elongated and is provided with a score line 12 approximately medially of the device. The score line 12 is provided so that the stop element or device can be divided into two parts. The upper part 14, being a closed end sleeve having a closed end 16 and an open end 18, as seen in FIG. 2 which occurs when the stop is separated. The bottom sleeve member 20 is provided with open ends 22 and 24.

Figure 3:
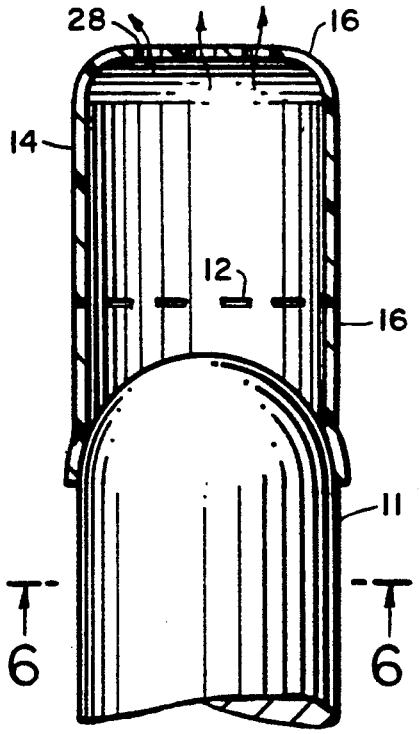
FIG. 3 is an elevational view of my broom or tool stop shown being applied to the free end of an elongated handle.
Figure 4:
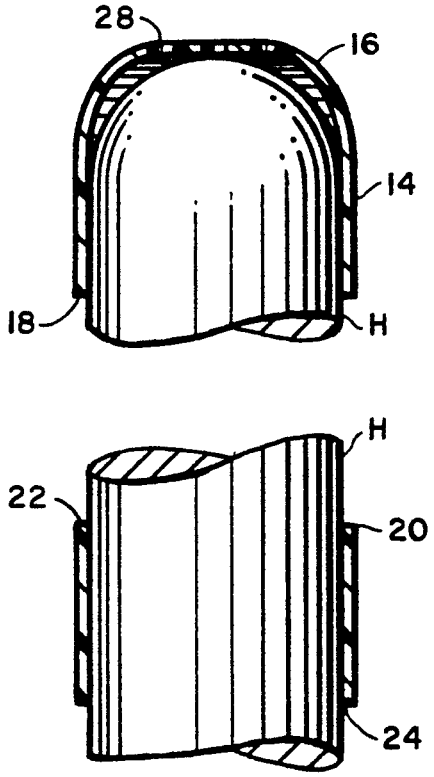
FIG. 4 shows the broom or tool stop which is severed along a median line of the device to provide a first tool stop at the extreme end of the elongated handle, and a severed part in a form of a ring placed further away from the stop device on the broom handle and functioning as a second tool handle stop.

As seen in FIGS. 1-5, 9 and 10 the exterior surface of the stop device 10 is provided with a non-skid frictional surface 19. The surface 19 extends 360 degrees around the entire periphery of the stop device so that the handle will be maintained in place when leaned against a wall or counter no matter what position or orientation the handle is in. The frictional surface serves to prevent the elongated handle of a broom, brush or tool from sliding down the wall or counter when placed against the same. It should also be noted that the lower ring, as seen in FIG. 4, form a second stop member in an intermediate position on the elongated handle. The second stop member can be selectively located on the handle so that it properly frictionally engages an edge of a counter at any time that the user would like to prop the broom, mop or the like up against the counter when not in use.

Figure 5:
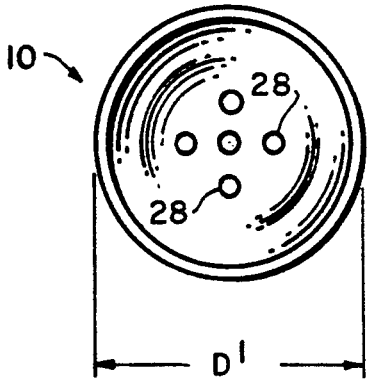
FIG. 5 is a view taken along the lines 5—5 of FIG. 2.
Figure 6:
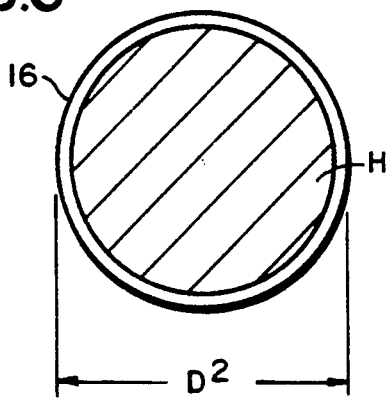
FIG. 6 is a view taken along the lines 6—6 of FIG. 3.

As seen in FIGS. 3, 5 and 6 the stop device 10 is flexible and its diameter D1 is slightly smaller than the diameter D2 of the part of the elongated broom handle to which the sleeve-like stop members are applied.

Figure 7:
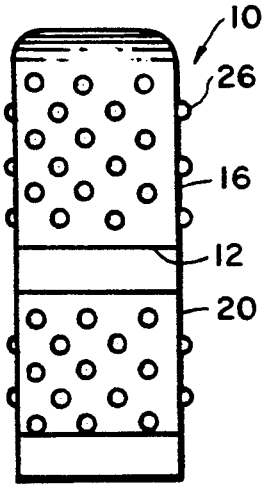
FIG. 7 is an alternate embodiment of the present invention in which a series of raised nubs are shown located completely about the circumference of the stop device.

As seen in FIG. 7 each of the stop members 14 and 20 is provided with plurality of nubs or circular projections 26 provided in a pattern around the entire circumference of the stop. In addition, each of the stop members is also provided with a series of random air holes 28, which are utilized to release the vacuum which may be present in the area between the stop device and the end of an elongated handle when the stop device is initially placed over the end of the handle.

As seen in FIG. 3, the present stop device is shown applied to the free end of an elongated handle for a broom or the like which may be placed against a vertical structure W, such as a wall, or a counter. Since the nubs 26 are located completely around the circumference of the stop member the structure affords a frictional surface 360° around the circumference of the stop member applied to the handle so that the handle will remain in place in its angular position against the wall no matter what the orientation of the broom or other tool using this device is. Thus, the handle for the broom, or the like, will not slide along the wall and consequently fall to the ground, but will remain in place so the user can once again easily grasp the tool without bending to pick up a tool that has fallen to the floor or ground and when it is the desired to use the tool.

Figure 8:
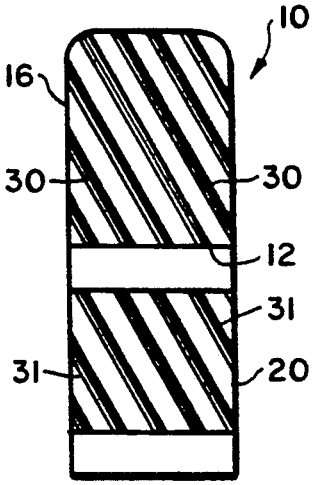
FIG. 8 is another embodiment of the present invention in which diagonal raised ribs are shown along the entire circumference of the stop device.

FIG. 8 shows another embodiment of my invention in which the stop device 10 is provided with spaced ribs 30 which are applied in a diagonal on the stop device. The outer surfaces 31 of each of the ribs are composed of a frictional material to prevent the end of the tool handle from slipping off a vertical surface.

Figure 11:
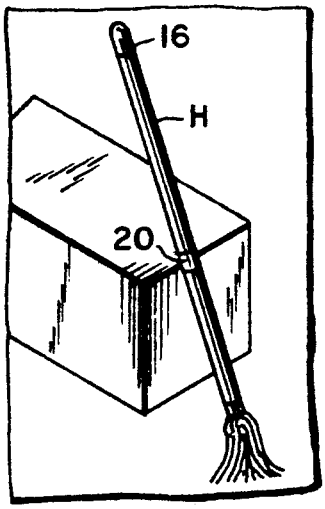
FIG. 11 shows the second tool handle stop as seen in FIG. 4 on the elongated handle resting against a corner of a counter.
Figure 12:
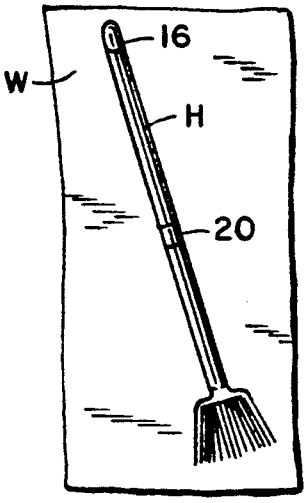
FIG. 12 shows a tool with the stop device on the extreme upper end of the elongated handle, and resting against an upright wall.

Referring to FIGS. 11 and 12, the elongated handle H can be propped up against the edge of a counter with the band 20 of the stop device resting against the corner of a counter C as seen in FIG. 11, or the handle H can be propped against a vertical surface, such as a wall W with the closed end sleeve 16 resting against the wall. Consequently, in both of the figures the tool handle remains in place and does not slide or fall to the floor or ground.

Figure 9:
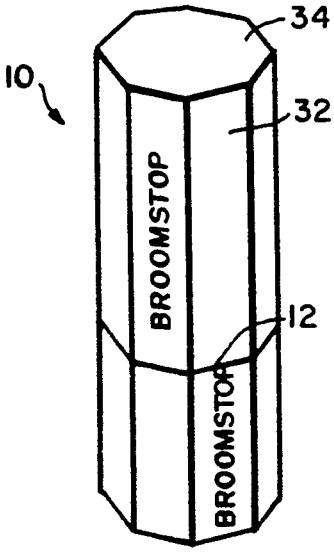
FIG. 9 is a further embodiment of the present invention in which the device is hexagonal in shape and is provided with indicia thereon.
Figure 10:
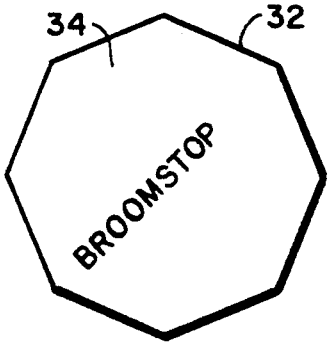
FIG. 10 is an enlarged top plan view of the device shown in FIG. 9.

Another version of the present invention is shown in FIGS. 9 and 10 in which the broom stop device is in the form of a hexagonal rubber sleeve which can be placed over the free end of an elongated handle of a tool. The hexagonal sleeve is provided with exterior flat faces on which can be applied, raised legends or pictures, or renderings of various tools that the device can be applied to.

It should also be apparent that the stop device can be placed on the free end of an elongated handle of a tool and left there whether in use or not and does not interfere with use of the tool or the storing of the same since the sleeve fits tightly over the end of the handle and can be stretched to accommodate various thickness of handles. Moreover, the stop device is relatively inexpensive to fabricate and can be transported in bulk because of the collapsible nature of the device.

Although the closed end stop member shown in FIG. 3 is preferred, the stop member 20 with open ends 22 and 26 may also be used depending upon the type of elongated handle on the tool. For example, the handle may have grasping elements at the extreme end at right angles to the elongated handle (not shown). Thus sleeve 20 can be slipped over oppositely projecting parts at right angles to the handle thereby functioning as a stop member for the grip of the elongated handle. In addition, it should be apparent that the stop member 20 can be placed on a fixed post, such as a piling at a dock, so that an object for example a boat hull can remain in contact with the piling when the boat is tied up to the dock because the stop member is provided with an outer frictional surface.

While the invention has been disclosed and described with reference to a limited number of embodiments, it will be apparent that variations and modifications may be made therein, and it is therefore intended in the following claims to cover each such variations and modifications as falls within the true spirit and scope of the invention.

What I claim is:

1. A stop for the free end of an elongated handle for a work device placed against a vertical wall comprising; a flexible sleeve inserted over said free end having a closed top and provided with a plurality of raised surfaces, a plurality of openings in said closed top for releasing the vacuum that is present in the space between the sleeve and the adjacent handle portion, said sleeve being provided with a circumferential score line substantially medially thereon for severing said sleeve along said score line to provide two separate stop members and said raised surface frictionally engaging said wall in any orientation of said handle to thereby maintain the handle in an upright position and preventing the sliding of the handle along said wall.

2. A stop device as claimed in claim 1 wherein the outer surface is provided with raised indicia.

3. A stop as claimed in claim 1 wherein said flexible sleeve is rubber.

4. A stop as claimed in claim 1 wherein said flexible sleeve is a thermoplastic.

5. A stop as claimed in claim 1 wherein said sleeve is cylindrical.

6. A stop as claimed in claim 1 wherein said sleeve is hexagonal.

7. A stop as claimed in claim 1 wherein one of said stop members is a rubber sleeve having one closed end, and the other stop member is a rubber band which is open on both ends.

8. A stop member as claimed in claim 1 wherein said raised surfaces are spaced elongated ribs, and each rib having a frictional outside surface for engaging an upright surface without sliding therealong.

* * * * *